US006273246B1

(12) United States Patent
Marciano

(10) Patent No.: US 6,273,246 B1
(45) Date of Patent: Aug. 14, 2001

(54) CASE COMPRISING TWO SHELL BODIES AND AN INSERT

(75) Inventor: Moshe Marciano, London (GB)

(73) Assignee: Swatch AG, Biel (CH)

( * ) Notice: Subject to any disclaimer, the term of this patent is extended or adjusted under 35 U.S.C. 154(b) by 0 days.

(21) Appl. No.: 09/498,753

(22) Filed: Feb. 7, 2000

(51) Int. Cl.[7] ..... B65D 85/40

(52) U.S. Cl. ..... 206/301; 206/5; 206/776; 220/4.01

(58) Field of Search ..... 206/5, 38.1, 301, 206/704, 37, 527, 776; 220/4.01

(56) References Cited

U.S. PATENT DOCUMENTS 4,216,858 * 8/1980 Beauchamp ..... 206/301
4,744,461 * 5/1988 Lapham ..... 206/5
5,263,577 * 11/1993 Paratte et al. ..... 206/38.1
6,119,864 * 9/2000 Kessler et al. ..... 206/704

* cited by examiner

*Primary Examiner*—Jim Foster
(74) *Attorney, Agent, or Firm*—Sughrue, Mion, Zinn, Macpeak & Seas, PLLC

(57) ABSTRACT

A case with two shell bodies (1) which may be assembled to each other transversely to the longitudinal axis of the case, comprises an insert (10) which is arranged parallel to the longitudinal axis of the case. One end of the insert may be inserted into one of the shell bodies (1), which is provided with an opening (13) for snapping-in a latching element (12). The insert (10) comprises an arm (11) which is biased in the direction of the opening (13) and which on the end side carries the latching element (12).

23 Claims, 4 Drawing Sheets

CASE COMPRISING TWO SHELL BODIES AND AN INSERT

BACKGROUND OF THE INVENTION

This invention relates to a case comprising two shell bodies which can be removably assembled to each other transversely to the length of the case.

Cases comprising shell bodies which can be assembled to each other transversely to the axis without hinges are used for the protective keeping of in particular elongate articles such as e.g. watches or glasses, but these cases however in the closed condition cannot be locked and bar the viewing of the article located therein.

BRIEF SUMMARY OF THE INVENTION

It is an object of the invention to provide such a case which can be locked and is easy to manufacture.

This object is achieved according to the invention by a case comprising two shell bodies which can be assembled to each other transversely to the longitudinal axis of the case, and further comprising an insert which is arranged parallel to the length of the case and which has one end arranged to be inserted into one of the shell bodies provided with an opening for snapping-in a latching element, said insert having an arm which is biased in the direction of the opening, said latching element being carried by an end of said arm.

There is thus created a case whose shell bodies are connectable to one another via an insert which is snapped into an opening on one of the shell bodies with a latching element arranged on an arm which is biased in the closing position, and which by way of pressure on the latching element is simply releasable again from the shell body.

By way of the biasing an actuation of the arm for locking is not necessary. The latching element snaps automatically into the opening on inserting the insert into the shell body.

The insert may at one end comprise two arms having an end-side latching element, which are biased in the direction of opposite walls of the associated shell body, wherein in the opposite walls there are provided suitable openings for snapping in the latching elements. With this the insert by way of pressure on the opposite latching elements, in particular by the index finger and thumb of a hand, is simply releasable again from the shell body, wherein at the same time the index finger and thumb grip the respective shell body and thus the shell bodies may be separated from one another.

The openings are preferably provided in the beginning of a section of the wall, which runs semicircularly towards the longitudinal axis of the case, so that the latching elements may be simply actuated.

In order to simplify the insertion of the insert, the shell body may be provided with guiding grooves which guide the latching element to the associated opening.

In order to counteract a slipping of the finger on actuation of the latching element for opening the case, the outer side of the latching element may have a gripping surface with a useful friction.

The insert may simultaneously serve as a carrier or holder for the article to be accommodated by the case, so that a separate element is not necessary for this.

The insert may comprise a middle part with a grid, resulting in a high stability with a simultaneous saving of material.

To act as holding means, prongs extending between the arms may be provided for supporting and/or retaining a part of the article.

Furthermore there may be provided guiding and/or retaining lugs integral with the insert, in order to fix the article in a predetermined position in the case.

The insert may where appropriate be connected as one piece to the other shell body.

In a preferred embodiment, the insert comprises at both ends at least one arm with an end-side latching element, both shell bodies having suitable openings for snapping-in the associated latching elements.

Further features of the invention can be deduced from the subsequent description and the dependent claims.

BRIEF DESCRIPTION OF THE DRAWINGS

The invention is hereinafter described in more detail by way of embodiment examples illustrated in the accompanying drawings.

DETAILED DESCRIPTION OF THE INVENTION

Figure 1:
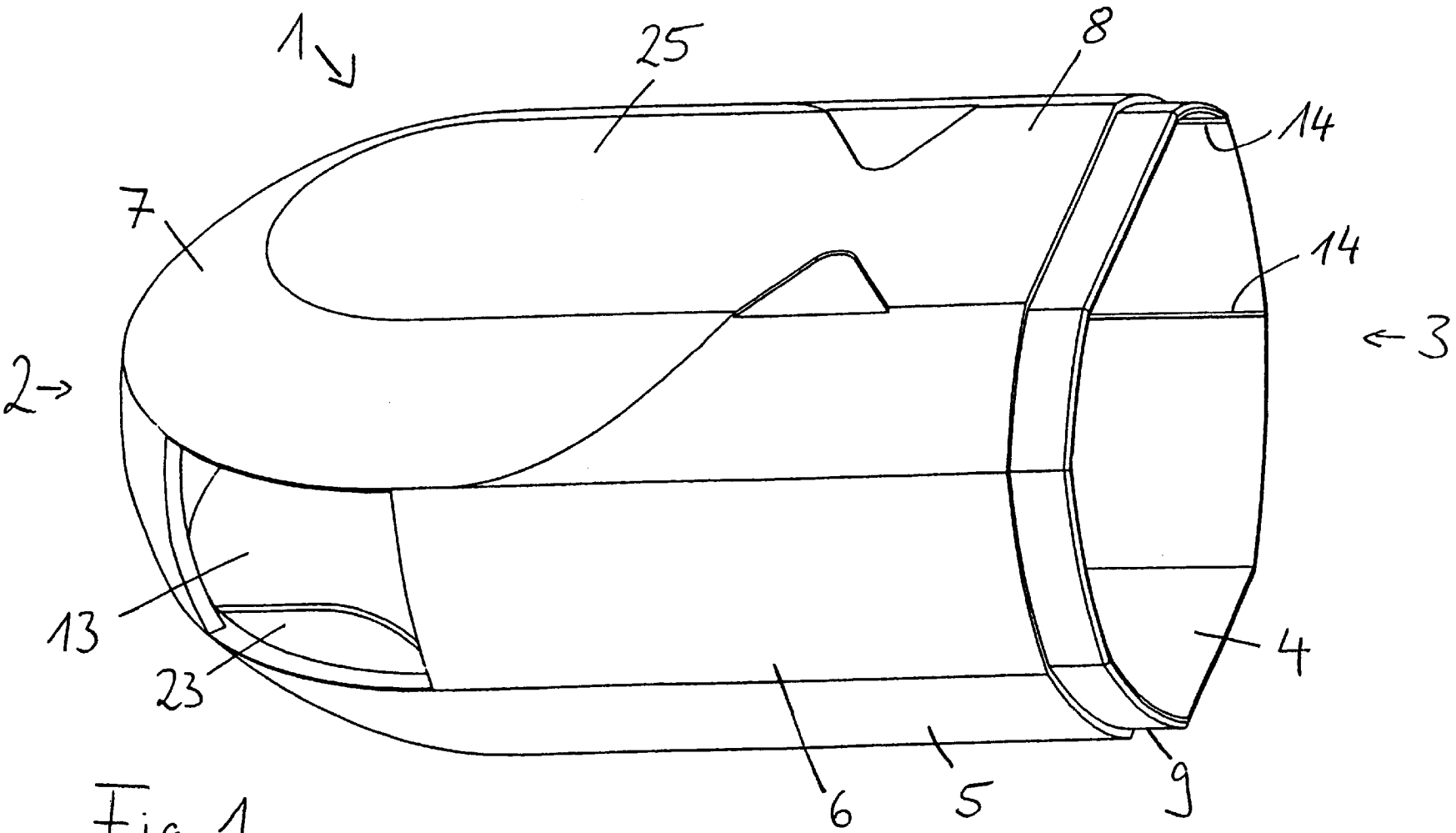
FIG. 1 shows a shell body of the case in a perspective view.

The elongate case illustrated comprises two corresponding shell bodies 1 (in FIG. 1 only one is represented) with one end 2 closed in a roughly semicircular shape and with an open end 3, wherein the section located between the ends 2, 3 has an substantially D-shaped cross section. The shell body 1 comprises a floor wall 4 which forms a mounting surface and which is surrounded by a U-shaped wall section 5 running obliquely to this, to which connects an substantially vertical, slightly rounded wall section 6. The upper side of the shell body 1 is formed by a further obliquely set U-shaped wall section 7 surrounding a cover wall 8 which is parallel to the floor wall 4.

At the open end 3 of the shell body 1 there is provided a circumferential extension 9 of reduced thickness for inserting into a second, non-shown shell body 1 which may be formed substantially as the shell body 1 and at its open end comprises an extension shaped complementarily to the extension 9.

The case comprises an insert 10 (FIG. 4) which is arranged parallel to the longitudinal axis of the case and which at least one, here at both ends 2, 3, comprises two arms each formed in the shape of a segment of a circle with an end-side latching element 12. The arms 11 are biased in the direction of opposite walls 6 of the associated shell body 1. Each of the opposite walls 6, preferably in the region of the beginning of a section of wall 6 running semicircularly towards the longitudinal axis of the case, has an opening 13 for the snapping-in of the corresponding latching element 12. The illustrated arms 11 are preferably formed as leaf springs, but may however also be biased by a spring.

Figure 3:
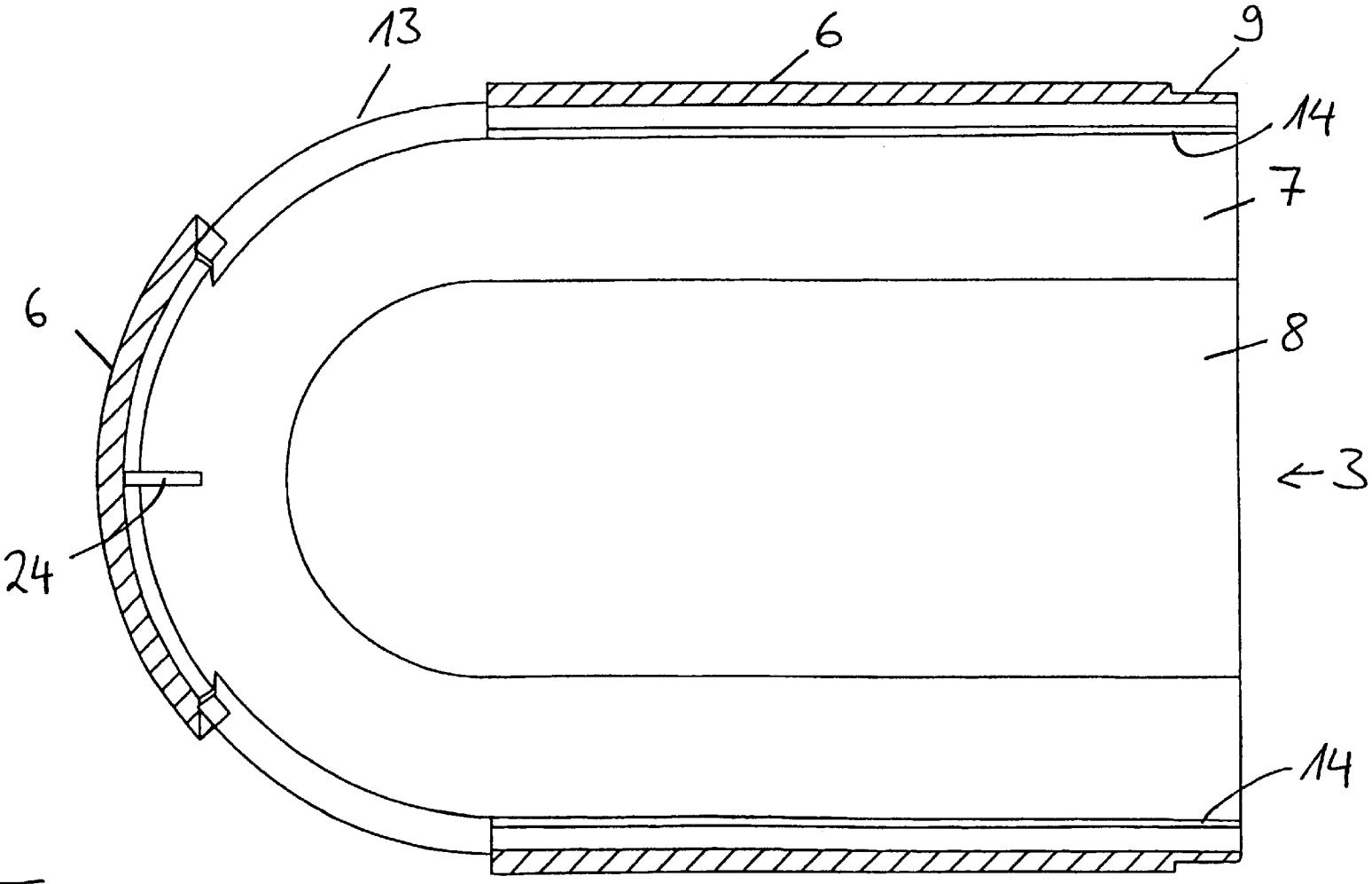

The inner sides of the opposite walls 6 each has a guiding groove 14, see FIGS. 1 and 3, which on inserting the insert 10 into the shell body 1 guides the corresponding latching element 12 towards the associated opening 13. The guiding groove 14 may be formed by the inclination of the walls 5, 7 with respect to the middle lateral wall 6, wherein the height of the latching elements 12 corresponds to the height of the wall 6. Additionally the inner side of the wall 6 may be recessed.

On its side accessible by way of the opening the latching element 12 usefully comprises a gripping surface 15 which counteracts a slipping of the finger and for example may be formed by way of a friction-increasing insert e.g. of a rubber-like material or by way of roughening.

The latching element 12 may for example be rectangular and comprises on its edge proximal to the open end 3 a latching surface 16 which runs preferably perpendicularly to the longitudinal axis of the case and which in the locked condition engages on the corresponding edge of the associated opening 13. Neighbouring the latching surface 16 the latching element 12 is smooth on the outer side so that on displacing the insert 10 within the guiding groove of the shell body 1 there arises as little friction as possible. The edge of the latching element 12 which is proximal to the closed end 2 may comprise an extension 17 on the inner side in order where appropriate to close a gap to the corresponding edge of the opening 13, in particular caused by tolerance.

The insert 10 comprises an substantially rectangular middle part 18 which usefully comprises a grid structure, which in particular comprises two rows of alternately directed triangles and a middle web 19. The arms 11 are preferably connected to the middle part 18 at corners and may be bent in the shape of a segment of a circle to form an annular section with the wall of the middle part 18 lying transversely to the longitudinal axis of the case.

Figure 4:
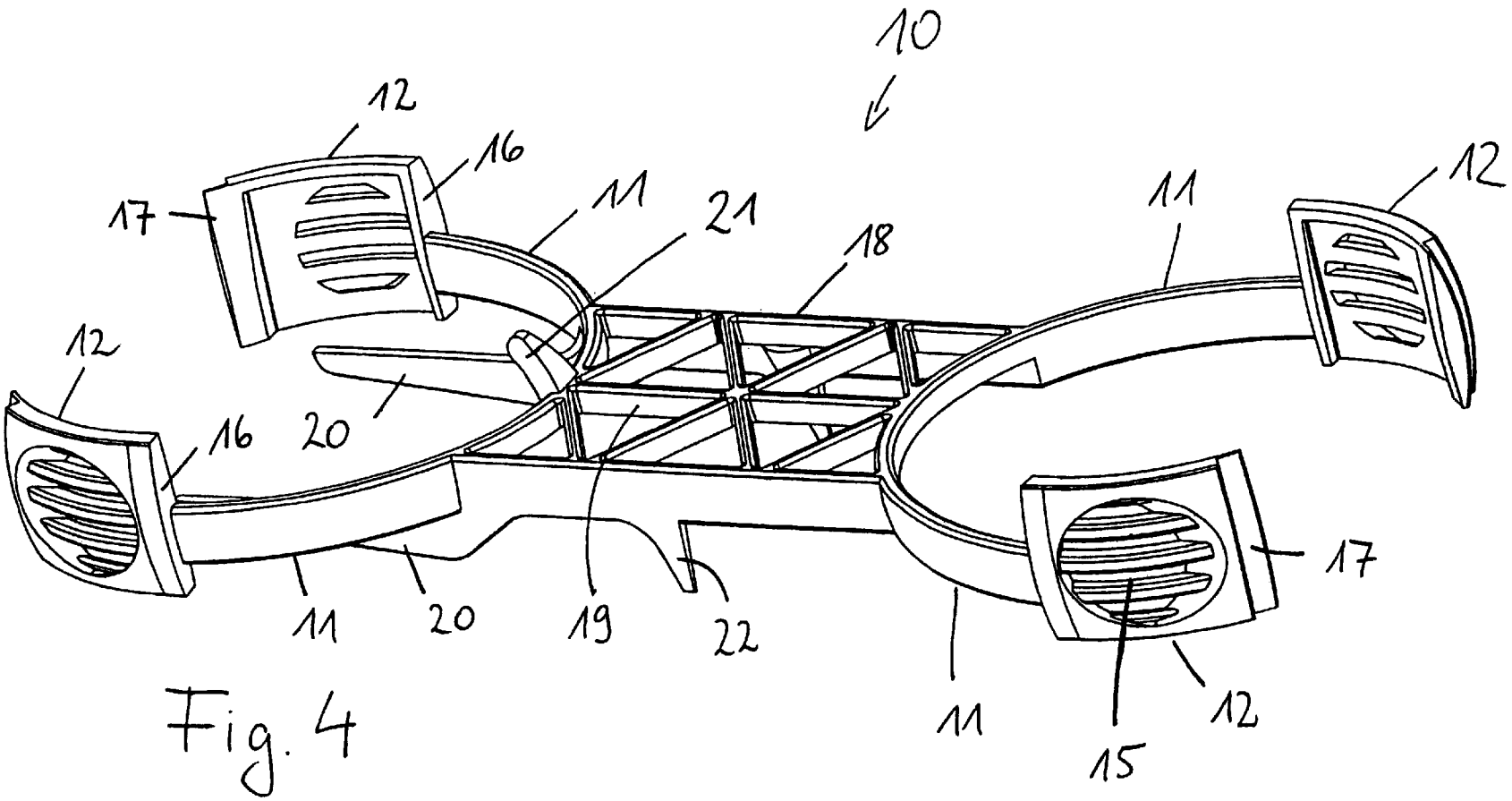
FIG. 4 shows an insert for the shell body of FIG. 1 in a perspective view.

The insert 10 is also used as a holder for an elongate article, in particular for a wrist watch. Preferably the article lies at least partly on the middle part 18 on which in particular there may be provided prongs 20 between the two arms 11 in the direction towards the free end, in particular parallel to the longitudinal axis of the case, for holding another section of the article, in particular a watch housing. The prongs 20 are usefully extensions of the lateral walls of the middle part 18, parallel to the longitudinal axis of the case, and may be offset with respect to the plane of the middle part 18 towards the floor wall 4, as is shown in FIG. 4.

Figure 2:
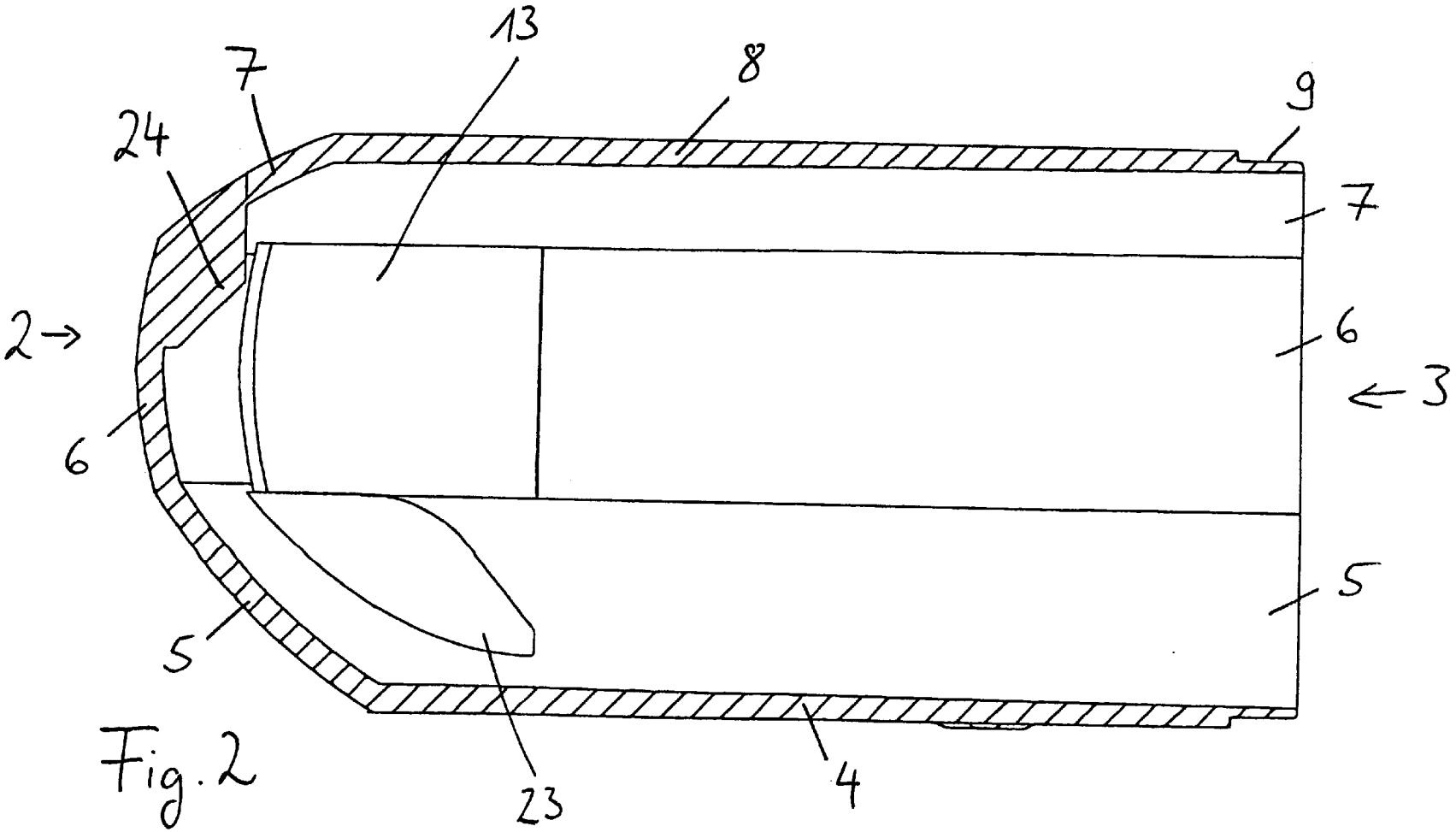
FIGS. 2 and 3 show the shell body of FIG. 1 in an axial section in two planes displaced by 90° to one another.

On the insert 10 and/or in the shell body 1 there may be provided guiding and/or retaining lugs 21, 22, 23, 24 for the article to be accommodated. A retaining lug 21 is arranged on the insert 10 in particular centrally between the prongs 20 and extends hook-shaped in the direction of the free end 2 of the shell body 1. The retaining lug 21 counteracts a lifting for example of a watch glass lying on the prongs 20. Laterally on the middle part 18 there may be arranged guiding lugs 22 which project opposite the middle part 18 in particular in the direction of the lower wall 4 and between which for example a watch strap of a wrist watch may be held. The guiding lugs 22 may for example be bent hook-shaped to one another for gripping around the watch strap. Furthermore retaining lugs 23 aligned with the prongs 20 may be provided on the inside on the shell body 1, preferably on the wall section 5. Also the wall section 6, 7 and/or the cover wall 8 may be provided with a retaining lug 24 corresponding to the retaining lug 21, see FIGS. 2 and 3.

The shell bodies 1 are preferably formed of transparent, in particular matt plastic and may comprise viewing windows 25 through which the accommodated article, in particular a watch housing, can be seen from the outside. The viewing windows 25 are preferably arranged on the floor wall 4 and the cover wall 8 in the region of the closed end 2 of the shell body 1.

What is claimed is:

1. A case comprising two shell bodies which are adapted to be assembled to each other transversely to a longitudinal axis of the case, and further comprising:

two latching elements, and an insert which is arranged parallel to the length of the case and which has one end arranged to be inserted into one of the shell bodies comprising two opposite walls provided with two respective openings for snapping-in said two latching elements, said insert having at said end two arms which are biased towards said openings, and said latching elements being carried by ends of said arms.

2. A case according to claim 1, wherein said arms are leaf springs.

3. A case according to claim 1, wherein said arms are biased by springs.

4. A case according to claim 1, wherein each latching element, at its side accessible by way of one of the openings, comprises a gripping surface.

5. A case according to claim 1, wherein an inner side of the shell body comprises at least one guiding groove for guiding the insert.

6. A case according to claim 1, wherein said openings are provided in a region of a beginning of a section of the walls running semicircularly towards the longitudinal axis of the case.

7. A case according to claim 1, wherein said insert is a holder for an elongated article.

8. A case according to claim 1, wherein said insert comprises a middle part having a grid structure.

9. A case according to claim 8, wherein a wall of the middle part lying in a section between the arms forms a circular section with the arms.

10. A case according to claim 8, wherein said insert comprises at least one prong extending between the two arms in the direction towards a free end of the case and parallel to the longitudinal axis of the case.

11. A case according to claim 10, wherein said prong is an extension of a wall of the middle part.

12. A case according to claim 10, wherein said prong extends parallel to the plane of the middle part of the case.

13. A case according to claim 10, wherein said prong is offset with respect to the plane of the middle part.

14. A case according to claim 7, wherein guiding and/or retaining lugs for the article are provided on the insert and/or in the shell body.

15. A case according to claim 14, wherein a retaining lug is arranged on the insert and extends hook-shaped in the direction of a free end of the shell body.

16. A case according to claim 14, wherein two guiding lugs are arranged laterally on a middle part of the insert or shell body, said lugs projecting opposite the middle part and lying opposite one another.

17. A case according to claim 1, comprising a flat rest surface.

18. A case according to claim 1, made of a transparent, matt material.

19. A case according to claim 1, wherein said shell bodies have viewing windows.

20. A case according to claim 1, wherein said shell bodies have equal lengths.

21. A case according to claim 1, wherein said insert is rigidly connected to one of the shell bodies.

22. A case according to claim 7, wherein said elongated article is a wrist watch.

23. A case comprising two shell bodies which are adapted to be assembled to each other transversely to a longitudinal axis of the case, and further comprising an insert which is arranged parallel to the length of the case and which has one end arranged to be inserted into one of the shell bodies provided with an opening for snapping-in a latching element, said insert having an arm which is biased in the direction of the opening, said latching element being carried by an end of said arm, wherein said arm is shaped as a segment of a circle.

* * * * *